US006656039B2

(12) United States Patent
Yamada

(10) Patent No.: US 6,656,039 B2
(45) Date of Patent: Dec. 2, 2003

(54) SOFTWARE PRODUCT AND VIDEO GAME DEVICE FOR PERFORMING A CARD GAME ON A VIRTUAL FIELD

(75) Inventor: Nobuhiro Yamada, Hannou (JP)

(73) Assignee: Konami Corporation, Tokyo (JP)

( * ) Notice: Subject to any disclaimer, the term of this patent is extended or adjusted under 35 U.S.C. 154(b) by 288 days.

(21) Appl. No.: 09/793,957

(22) Filed: Feb. 28, 2001

(65) Prior Publication Data

US 2001/0018358 A1 Aug. 30, 2001

(30) Foreign Application Priority Data

Feb. 29, 2000 (JP) ..... 2000-053297

(51) Int. Cl.[7] ..... A63F 9/24
(52) U.S. Cl. ..... 463/11; 273/292; 273/308
(58) Field of Search ..... 463/1, 9, 30, 11, 463/36, 40, 42, 43; 273/236, 237, 292–293, 303–308, 459–461

(56) References Cited

U.S. PATENT DOCUMENTS 5,163,688 A 11/1992 Simms
5,662,332 A 9/1997 Garfield
5,954,332 A 9/1999 Mero et al.

FOREIGN PATENT DOCUMENTS

JP 137534 5/2001

OTHER PUBLICATIONS

Yu–Gi–Oh Duel Monsters Perfect Master Book vol. 1, published by Shueisha, Dec. 21, 1998, p. 12–22.

Learn Magic Card (Japanese Version), written by Larry W. Smith published by Shinkigensha, Dec. 22, 1995, p. 55–64, 31–32, 39–40.

*Primary Examiner*—Mark Sager
(74) *Attorney, Agent, or Firm*—Sughrue Mion, PLLC

(57) ABSTRACT

A software product and a video game device for virtually performing a card game like a trading card game. Cards of the card game are given parameters each of which shows ability point or property of the card. When a player designates a first card to present it on a field (or "summon" the first card), an index parameter given to the card is compared with a threshold. If the index parameter is over the threshold, the player must "sacrifice" some cards from cards currently presented on the field in order to "summon" the first card.

2 Claims, 7 Drawing Sheets

SOFTWARE PRODUCT AND VIDEO GAME DEVICE FOR PERFORMING A CARD GAME ON A VIRTUAL FIELD

BACKGROUND OF THE INVENTION

This invention relates to a video game device and a software product, both of which serve to perform a computerized card game.

Traditional types, such as poker, contract bridge, and the like, of card games have been played by using a predetermined number of deck cards. For example, a deck or pack of general playing cards are always composed of fifty-three cards, namely, thirteen spades, thirteen hearts, thirteen clubs, thirteen diamonds and one joker. In most card games, the deck of playing cards is shared among plural players joining a game.

Recently, another type of a card game that is different from the traditional card games becomes popular among young people and is called "trading card game". Conventionally, a wide variety of such trading card games have been also proposed each of which has a lot of fans. In contrast to the traditional card decks, such trading card games are usually played by the use of each deck of cards different from one another. However, it is to be noted that all the trading card games are common to one another in the viewpoint of being played through the following three stages.

At first stage, players of each trading card game must gather their cards from various kinds of cards that have been issued in order to build their decks. Each type of cards has a different effect in the game and the more effective a card is, the less the card is issued. A pack of cards is usually sold with being packaged and players can not identify contents or species of cards packaged before they purchase it. As a result, decks of players would have different card constructions from each other, and if a player wants to build a powerful deck, the player should collect more cards.

At second stage, each player selects predetermined number of cards from his collection to build a deck. Usually, a card has ability points and properties, and an ability point may be modified according to its property. Furthermore, there are cards that have special effects in addition to or except basic ability points and properties. Therefore, in order to build a mighty deck in real game, each player must not only collect cards with high ability points but also select cards suitable for his game strategy in consideration of properties and special effects. A good player could build a deck advantageous to the opponent's deck if the good player knows the opponent's card list. And at third stage, two players individually prepare their decks from their collections of cards and thereafter start a trading card game among them. They draw some cards for their hands from their decks and then each of them puts a card from his hand on a game field by turns. Card-to-card matches are made between cards on the field repeatedly and after a series of matches a winner or a loser of the game is decided.

At the first stage mentioned above, players have fun to collect cards to strengthen their decks. A provider who provides the trading card game should increase types of cards to enhance player's fun. One easy way to increase species of cards results in raising upper limits of ability points. This way is likely to destroy the balance of game. Specifically, if a lot of species of cards have high ability points, players who can get more cards become too advantageous to players who can not get them. In this case, the later would be unable to beat the former even if the later is an excellent player. It is likely to upset game balance to easily raise the upper limits of ability points, as mentioned above.

Each trading card game has been computerized as a video game these days. Compared with the above-mentioned trading card games paper-printed, such a computerized trading card game is so difficult to increase the number of card species. Accordingly, a great number of card species and cards should be prepared in advance in each computerized trading card game before the beginning of supplying the game to players.

On the other hand, paper-printed trading card games can easily increase card species by only issuing new card species in addition to the existing card species. One player who bought the new card and another who did not buy the card can play the game together.

On the other hand, it is difficult to increase card species of each computerized trading card game to twice or three times. Furthermore, both players who want to play the game together would have to update both of their video game software products. It might be considered to supply an updated part as a differential file or files to all players in order to update their video game software products at the same time. It should be considered that most users of these devices are very young. This way is not suitable for children. Accordingly, this way can not apply to update software products common to consumer video game devices and portable video game devices.

SUMMARY OF THE INVENTION

It is an object of this invention to provide software products and video game devices which are suitable for a trading card game and which can keep a game balance of the trading card game, even if ability points in the trading card game has a wide difference between upper and lower limits.

It is another object of this invention to provide software products and video game devices of the type described, which can prepare a great number of card species in the trading card game.

According to this invention, a software product and a video game device for virtually performing a card game like a trading card game is provided. Cards of the card game are given parameters each of which shows ability point or property of the card. When a player designates a first card to present it on a field (or "summon" the first card), an index parameter given to the card is compared with a threshold. If the index parameter is over the threshold, the player must "sacrifice" some cards from cards currently presented on the field in order to "summon" the first card.

Namely, according to this invention, a software product to be executed by a video game device, representing a card game on a virtual field each of whose cards has at least one parameter, repeating processes comprising the processes of: presenting a card from a player's hand on the field; computing a judgement with reference to parameters of the cards on the field; and removing at least one card according to the judgement; in order to represent one game is provided. This software product further comprises a card presentation process comprising the processes of: designating a first card from a player's hand; comparing an index parameter given to the first card with a predetermined threshold; designating at least one card from currently presented cards on the field as a sacrificed card if the index parameter is over the threshold; removing the sacrificed card from the field; and presenting the first card.

In the software product, a parameter given to the first card may serve both as the index parameter and another parameter.

In the software product, the index parameter may be computed with reference to plural parameters given to the first card.

The software product may further comprise the process of modifying parameters before the process of computing a judgement with reference to parameters of the cards on the field.

The card presentation process may decide the number of cards designated as sacrificed cards according to a parameter given to the first card.

Furthermore, according to this invention, a video game device performing a card game on a virtual field each of whose cards has at least one parameter, comprising processing units for: presenting a card from a player's hand on the field; computing a judgement with reference to parameters of the cards on the field; and removing at least one card according to the judgement; in order to representing one game is provided. The video game device further comprises a card presentation processing unit comprising the processing units of: designating a first card from a player's hand; comparing an index parameter given to the first card with a predetermined threshold; designating at least one card from currently presented cards on the field as a sacrificed card if the index parameter is over the threshold; removing the sacrificed card from the field; presenting the first card.

In the video game of the video game device, a parameter given to the first card may serve both as the index parameter and another parameter.

In the video game of the video game device, the index parameter may be computed with reference to plural parameters given to the first card.

The video game device may further comprise the processing unit of modifying parameters before computing a judgement with reference to parameters of the cards on the field.

The card presentation processing unit may decide number of cards designated as sacrificed cards according to a parameter given to the first card.

DESCRIPTION OF THE PREFERRED EMBODIMENTS (1) Video Game Device

Figure 1:
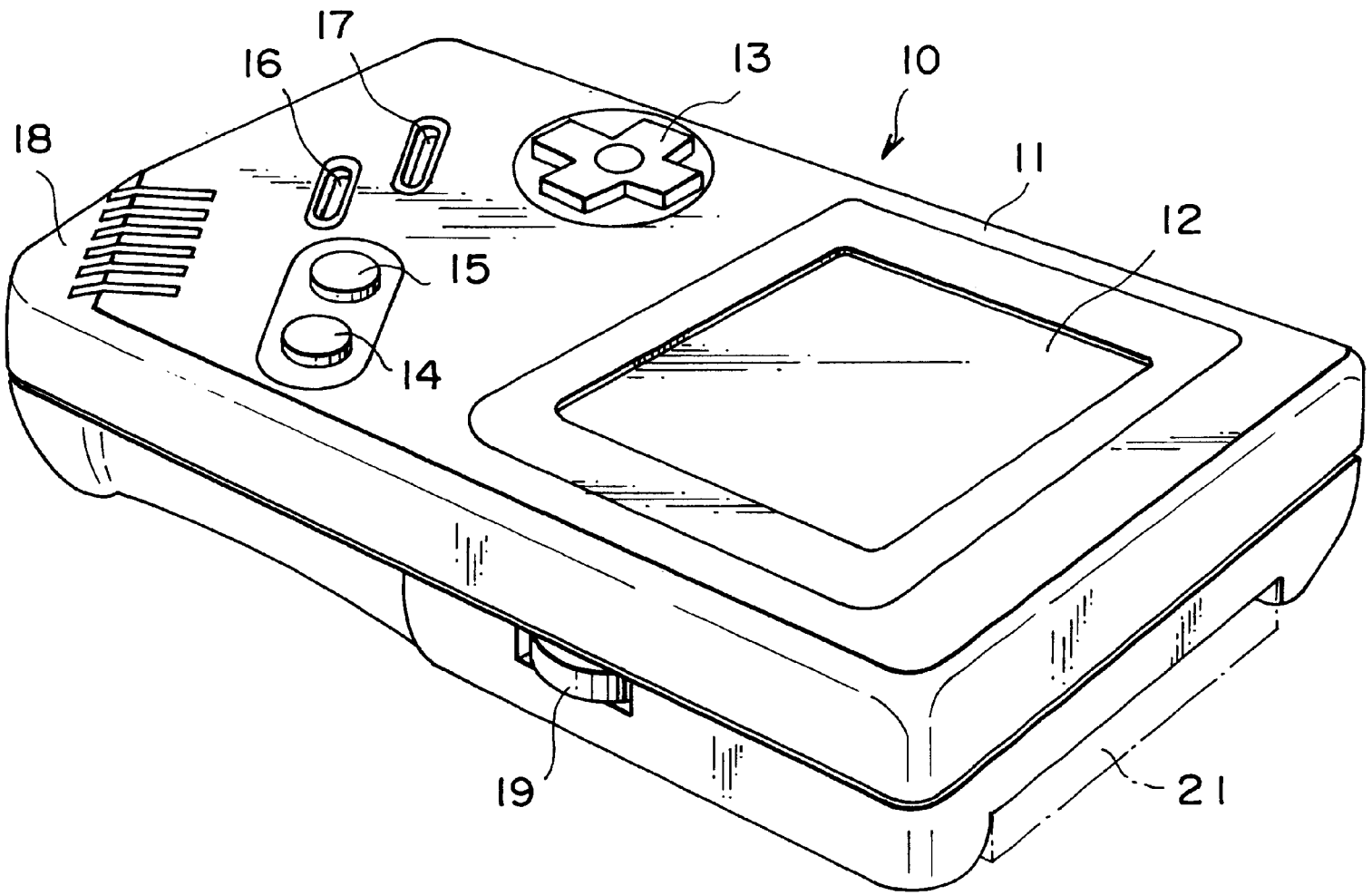
FIG. 1 shows a perspective view of a portable video game device 10 that preferably performs a video game program of this invention.

A video game device preferable for the video game program of this invention will be described as follows. As shown in FIG. 1, the portable video game device 10 is covered with a case 11. On an upper front of the case 11, a liquid crystal display (LCD) panel 12 is placed. On a lower front of the case 11, various kinds of switches 13–17 and a speaker 18 is placed. On an upper back of the case 11, a cassette slot 20 (not shown) is opened so as to be connected to a detachable external ROM cassette 21. Further, a sound volume dial 19 is installed on a side of the case 11.

The external ROM cassette 21 can store various kinds of video game programs for the portable video game device 10. Thus, when a player gets the external ROM cassette 21 storing a video game program of this invention, the player can perform the video game program with the portable video game device 10 and play the trading card game of this invention.

When a player enjoys video game by the use of the portable video game device 10, the player holds the lower part of the portable video game device 10 with his both hands so as to place the LCD panel 12 above and face the LCD panel 12 toward the player. The switches 13–17 are placed so as to be operable with the player's thumbs. The left thumb operates a cross key switch 13 and right thumb operates push button switches 14 and 15. Functions of the cross key switch 13, push button switches 14 and 15 are previously determined by a video game program stored in the external ROM cassette 21. The start switch 16 and the select switch 17 are operated when a menu of the video game is displayed on the LCD panel 12. The sound volume dial 19 adjusts sound volume of the speaker 18.

Figure 2:
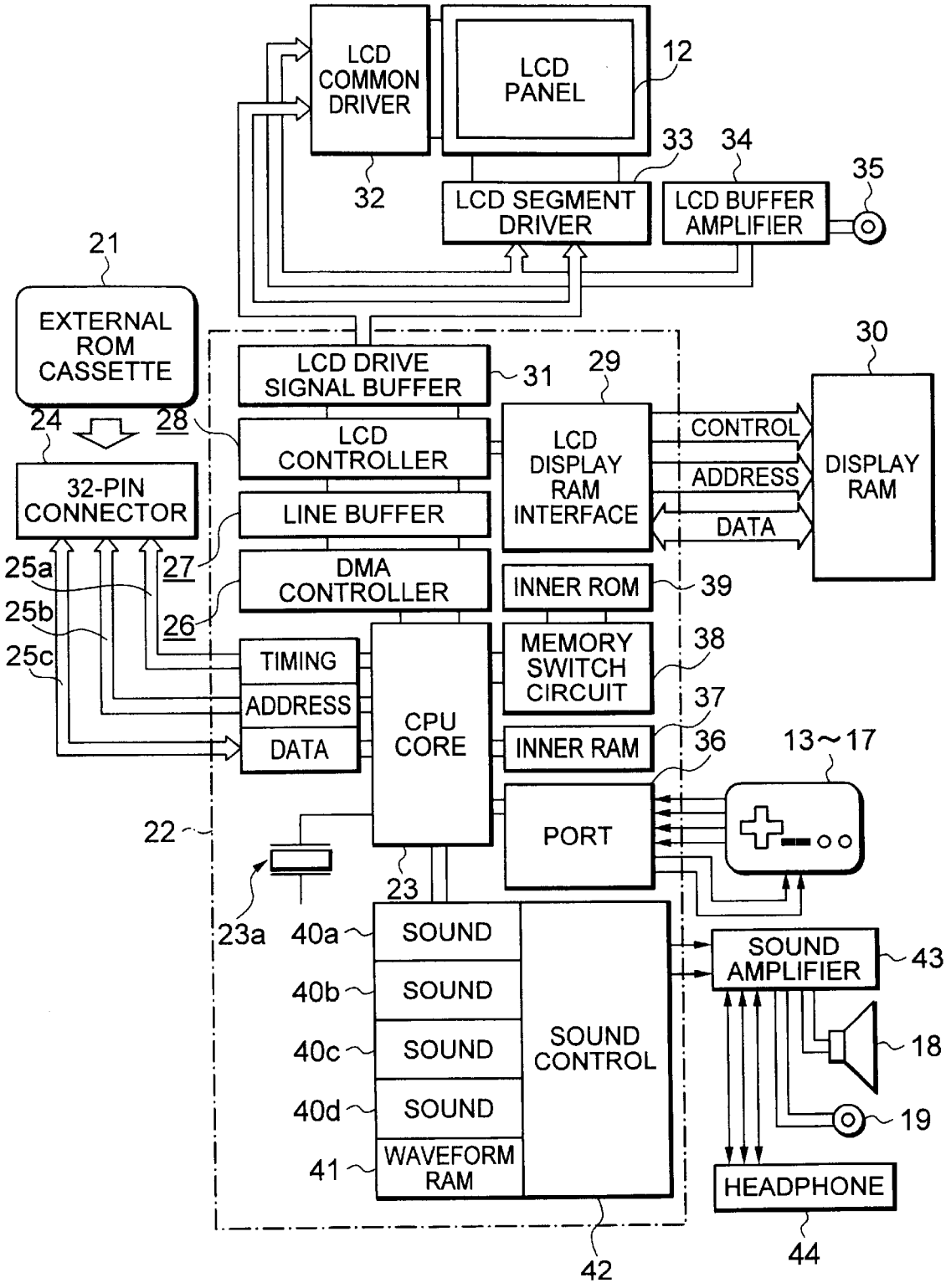
FIG. 2 shows a block diagram of the portable video game device 10.

Next, description will be specifically made about components of the portable video game device 10 with reference to FIGS. 1 and 2. In the portable video game device 10, a CPU 22 is centered among or electrically coupled to the external ROM cassette 21, LCD panel 12, switches 13–17, speaker 18, sound volume dial 19 et al, as shown in FIG. 2. Inter connections between the above-exemplified units and a CPU core 23 of the CPU 22 will be described in detail in the following.

The external ROM cassette 21 is inserted to the cassette slot 20 and connected with the CPU 23 via a 32-pin connector 24, buses 25*a*, 25*b* and 25*c*.

The CPU core 23 outputs image signals to an LCD controller 28 via a line buffer 27 under the control of a DMA controller 26. The LCD controller 28 is connected with a display RAM 30 via a LCD display RAM interface 29. The display RAM 30 includes character RAM and VRAM. Thus, the LCD controller 28 transforms display data outputs from the CPU core 23 into LCD drive signals from the display RAM 30.

Namely, display data outputs from the CPU core 23 designate or include addresses of the character RAM and VRAM. The character RAM and VRAM output character signals and object signals (background image signals) and then theses signals are synthesized into the LCD drive signals by the LCD controller 28.

The LCD drive signals are sent to an LCD common driver 32 and an LCD segment driver 33 via an LCD drive signal buffer 31. Therefore, under the control of the LCD common driver 32 and LCD segment driver 33, display data from the CPU core 23 are displayed on the LCD panel 12.

Further, the LCD common driver 32 and LCD segment driver 33 are connected with an LCD buffer amplifier 34 which is connected with a luminance adjustment dial 35. Luminance of the LCD panel 12 is adjustable with the luminance adjustment dial 35. Though the luminance adjustment dial 35 is not shown in FIG. 1, the luminance adjustment dial 35 is placed on the left side of the case 11 and opposite to the sound volume dial 19.

The switches 13–17 are connected with the CPU core 23 via a port 36. The CPU core 23 is connected with an inner RAM 37. The CPU core 23 is connected with an inner ROM 39 via a memory switch circuit 38. Only when the memory switch circuit 38 selects a preselected memory area (will be called a first memory area) of the inner ROM 39, the CPU core 23 can access the inner ROM 39.

An oscillator 23*a* is connected with the CPU core 23. Sound circuits 40*a*–40*d* receive output from the oscillator 23*a* and generate sound signals. The sound circuits 40*a*–40*d* generates different sound signals from one another. Related to the sound circuits 40*a*–40*d*, a waveform RAM 40 is installed in order to change tone of sound signals output from the sound circuits 40*a–d*. For example, the waveform RAM 41 stores 4 bits×32 steps of waveforms to output tone signals to the sound circuits 40*a–d*. A sound control circuit 42 processes the sound signals output from the sound circuits 40*a*–40*d* to generate two sound signals which are representative of approximate stereo sounds. These two sound signals are amplified by the sound amplifier 43 and are then output from the speaker 18 or a headphone 44.

(2) Video Game Program

Description will be next directed to a video game program according to this invention. The video game program is performed on the video game device described in the above-chapter (1). The video game program is stored in the external ROM cassettes 21 and provided to players. When the player plays the video game, the player inserts the external ROM cassette 21 to the cassette slot 20, turns on the portable video game device 10, and pushes the start switch 16. Then, the portable video game device 10 executes the video game program. After starting the video game, the player operates the cross key switch 13 and pushes button switch 14 and 15 to play the video game. The video game is displayed on the LCD panel 12 along with music and/or various sound effects from the speaker 18.

The video game is performed as one-on-one duel style game. In the video game, two players (Player 1 and Player 2) duel with each other. Each of the players starts the game with a predetermined hit point (HP) given. A decision of each match between cards is repeatedly made. When one player's card beats the opponent's card, the opponent loses his/her HP. When one player loses all HP, the other player wins the game.

In the video game, a card shows an image that stands for a feature of the card, various kinds of ability points and/or properties, and a legend about the card. A player puts a card from his hand to a field (namely, a virtual battle field) and designates offense or defense of each card of the player placed on the field. When a player designates a card offense, the player further designates a target card among the opponent's cards on the field. Then, a card-to-card match is made against both the players to decide either a winner or a loser. As a result, the loser player's HP is decreased.

Figure 3:
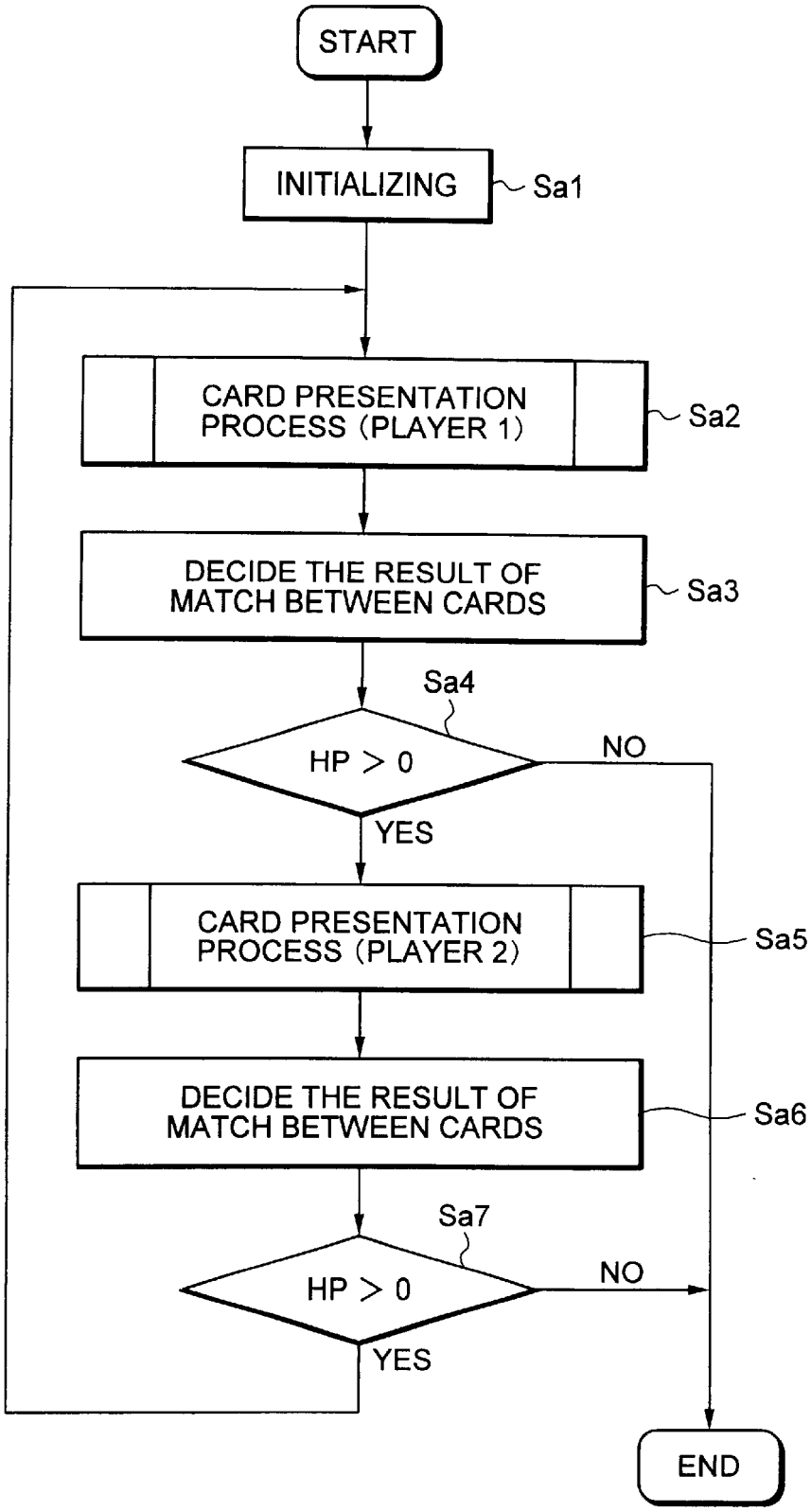
FIG. 3 shows a flowchart for use in describing a video game program of this invention.

Detailed description about progress of the video game is made below with reference to FIG. 3. First, let players 1 and 2 construct their deck to start a duel (STEP Sa1). Each of them selects forty cards from his/her own cards to construct a deck that will be used in the duel. The constructed deck is shuffled, and then five cards from the top of the deck are drawn as his/her hand.

Next, Player 1 selects one card from his hand and presents the card on the field (STEP Sa2). STEP Sa2 may be called card presentation process below. The card presentation process is described later.

Player 1 designates either of offense and defense of each card placed on the field. If at least one card is designated as offense, Player 1 further selects a target card of Player 2's cards on the field for each offense card. Then, card-to-card decision is made between the offense card and the corresponding target card against the offense card (STEP Sa3).

Card-to-card decision is made by comparing an ability point of the offense card with an ability point of the target card. The ability point obtained from the offense card is an offense point. The ability point obtained from the target card depends on whether the target card is designated as offense or defense by Player 2. When Player 2 designated the target card as offense, the ability point of the target card is handled as an offense point. On the other hand, when Player 2 designated the target card as defense, the ability point of the target card is handled as a defense point.

For example, it is assumed that Player 1 designates Card A as offense against Player 2's Card B. Herein, let the offense and defense points of Card A be equal to 1000 and 800 respectively. On the other hand, let the offense and defense points of Card B be equal to 700 and 500 respectively. Under the circumstances, if Player 2 also designates Card B as offense, 1000 (the offense point of Card A) and 700 (the offense point of Card B) are compared with each other. If Player 2 designates Card B as defense, 1000 (the offense point of Card A) and 500 (the offense point of Card B) are compared with each other.

As described above, card-to-card decision is made with reference to ability points of an offense card and its target card, and then the card of which the ability point is lower than the other is removed from the field. Further, if the loser card is designated as offense, a deference between the offense point of the offense card and the offense point of the target card is calculated and the deference is subtracted from the loser player's HP.

Then, HPs of Players 1 and 2 are counted up or down (STEP Sa4). When the HP of either one of Players 1 and 2 becomes equal to zero, the other player wins the duel and the duel ends. As long as the HP's of both of Players 1 and 2 are more than zero, STEPs Sa5 to Sa7 are followed by STEPS Sa2 to Sa4 which are repeatedly executed on both of Players 1 and 2.

(3) Card Presentation Process

Figure 4:
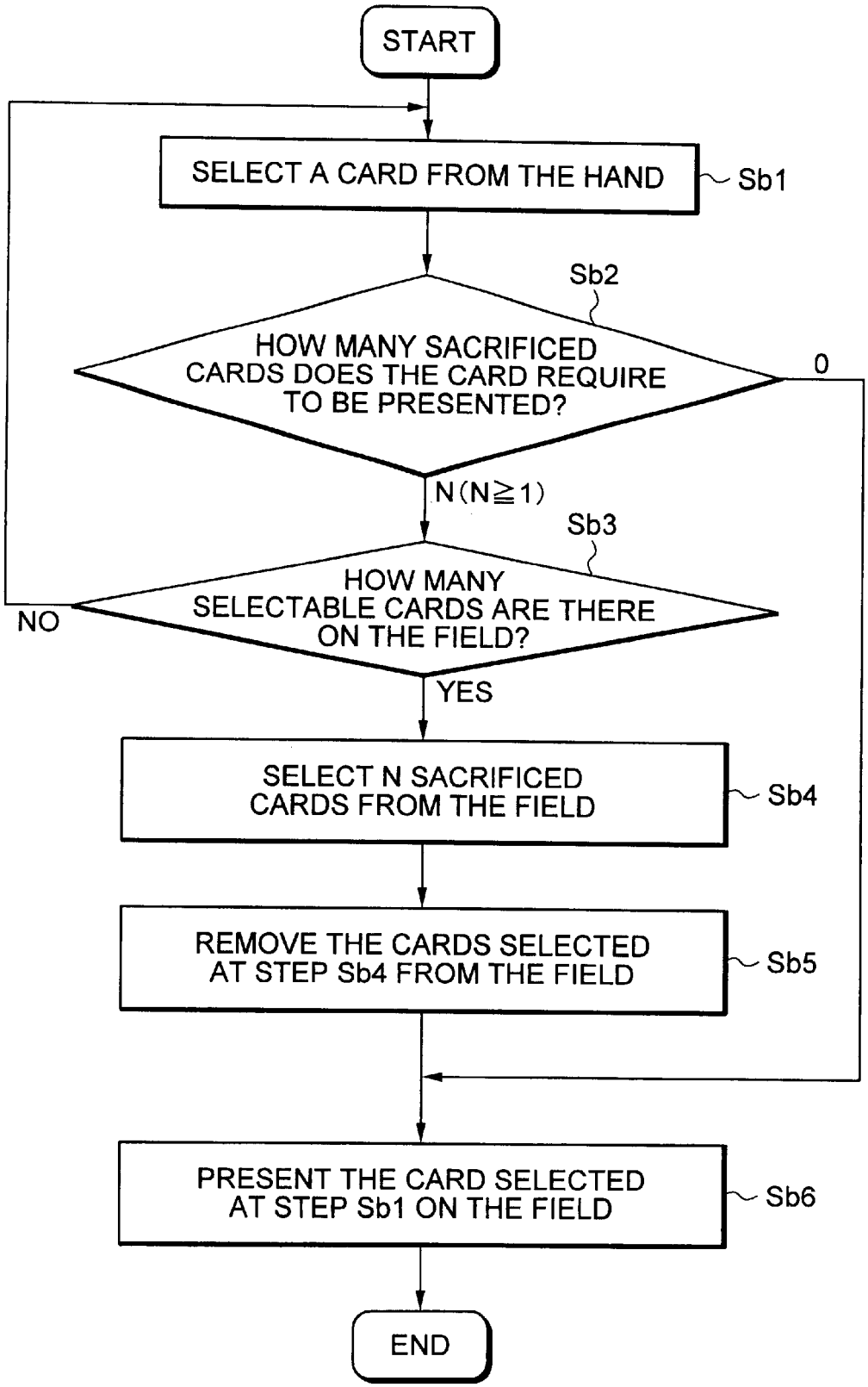
FIG. 4 shows a flowchart for use in describing a card presentation process.

The card presentation process executed at STEPs Sa2 and Sa5 illustrated in FIG. 4 will be described below with reference to FIG. 4. In the card presentation process, a player selects one card from his hand and presents the card on the field. The card presentation process of this invention is different from that of a conventional video game. In order to facilitate understanding of this invention, the conventional card presentation process will be mentioned below.

In the conventional card presentation process, a player can select any card in his current hand independently of its card type. The conventional card presentation process merely means a process of presenting a card selected from a player's current hand on the field.

On the other hand, the video game of this invention imposes conditions on presenting a card to the field. In the video game of this invention, when a player presents a card of some types or species on the field, the player is required to satisfy a card presentation condition. The card presentation condition is established in connection with a certain card type according to its strength, effectiveness, rareness or the like. In general, a strong card is given a heavy card presentation condition and a weak card is given a light card presentation condition. In short, it is to be noted that the video game of this invention introduces a trade-off relationship between strength and handiness of card.

According to the trade-off relationship, to possess a lot of strong cards is not always unconditionally advantageous. Because a strong card requires satisfying heavy card presentation condition so that a player can not always present a strong card on the field, and on the other hand, a weak card requires less or no condition so that a player can always present a weak card.

One example of card presentation condition is described below. The card presentation condition is "to remove your N cards on the field" (N is a natural number). In the following, a card that is removed from the field in exchange for satisfying a card presentation condition is called a sacrificed card. The required number N of sacrificed cards is determined according to parameters of the card that will be presented on the field. Referred parameters of the card may be, for example, ability points and properties and are called index parameters.

A parameter like an offense or defense point mentioned above may be referred to as an index parameter. Alternatively, plural parameters may be combined with each other so as to generate an index parameter. A parameter that is referred to determine an index parameter is called a reference parameter below. In either case, an index parameter does not have to be newly added to parameters of a card. For example, an index parameter can be determined by the following Formula (1):

$$I=(P_O+P_D)/800 \quad (1)$$

where

I: index parameter $P_O$: Offense point $P_D$: Defense point

If an index parameter is determined according to reference parameters, at least one of the reference parameters may be a variable. In development of a duel, reference parameters are often modified according to other parameters. In this case, the index parameter has to be computed with reference to current values of the reference parameters.

For example, one of the video games of this invention may be embodied such that the field has some attributes like forest, wilderness, mountain, plain, sea, and darkness. Each card has its own property. And offense/defense point is modified according to relationship between property of the field and property of the card. As an example of this video game, some sacrificed cards may be needed to present a card on the field when the property of the field is forest, but no sacrificed card is needed to present the same card on the field when the property of the field is sea. It should be noted that variable parameters like this are unable to be realized by a paper-printed card game.

An index parameter of a card is compared with a predetermined threshold. When the index parameter is larger than the threshold, some sacrificed cards are required to present the card. Plural thresholds may be prepared so as to individually determine numbers of required sacrificed cards. In this case, a stronger card requires a greater number of sacrificed cards and consequently, ruin of the rules caused by an increase of strong card becomes avoidable. Further, a difference between the upper and lower limits of parameters can be enlarged, and as a result, more card types can be introduced in the video game.

An index parameter may be included as an independent parameter in parameters of a card. In this case, a parameter that means the number of required sacrificed cards to present the card on the field is further added to parameters of the card.

Next, the card presentation process is described with reference to FIG. 4 more in detail. In the following description, it is surmised that offense and defense points are independent of property of the field. Each card has an index parameter independent of the other parameters. When the value of the index parameter is from zero to four, number of sacrificed cards N is equal to zero. When the value exceeds five or six, N is equal to one. And when the value is seven and over, N is equal to 2.

Figure 5:
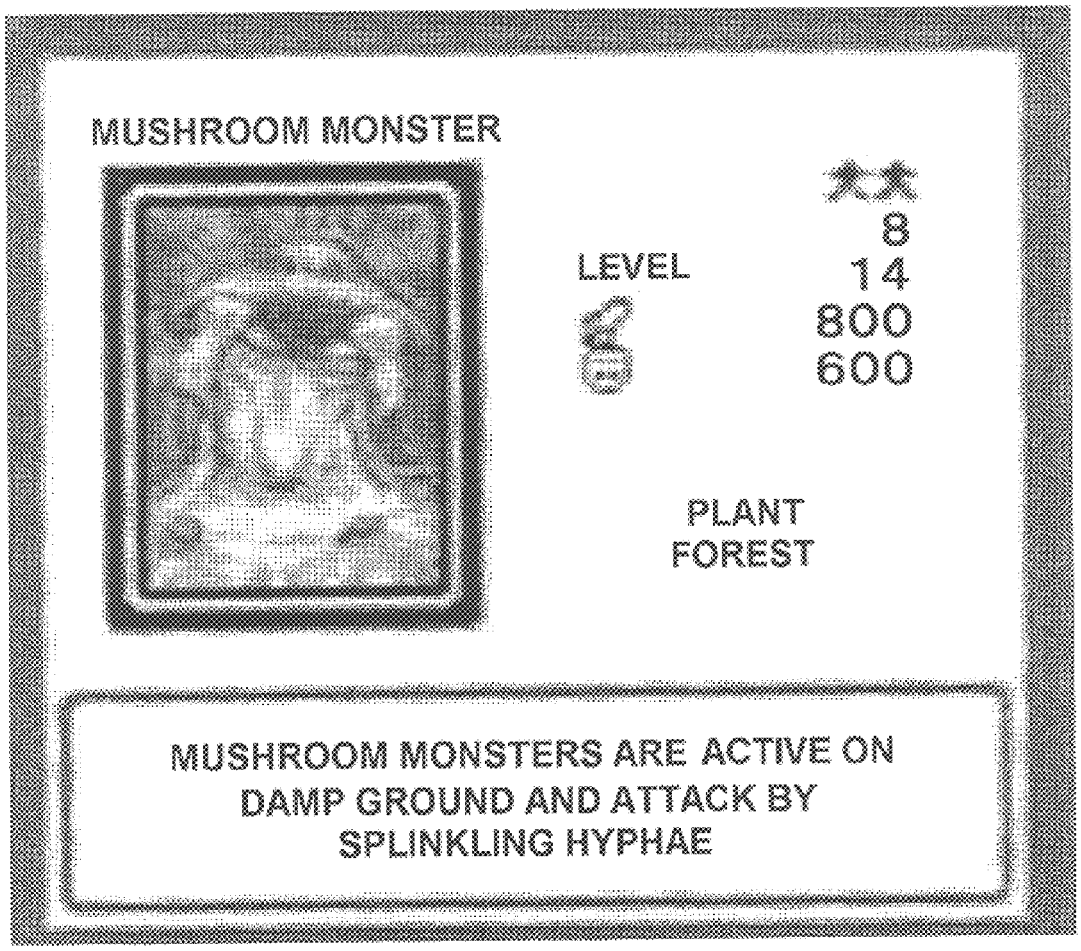
FIG. 5 shows a screen view for displaying ability points and properties of a card.
Figure 6:
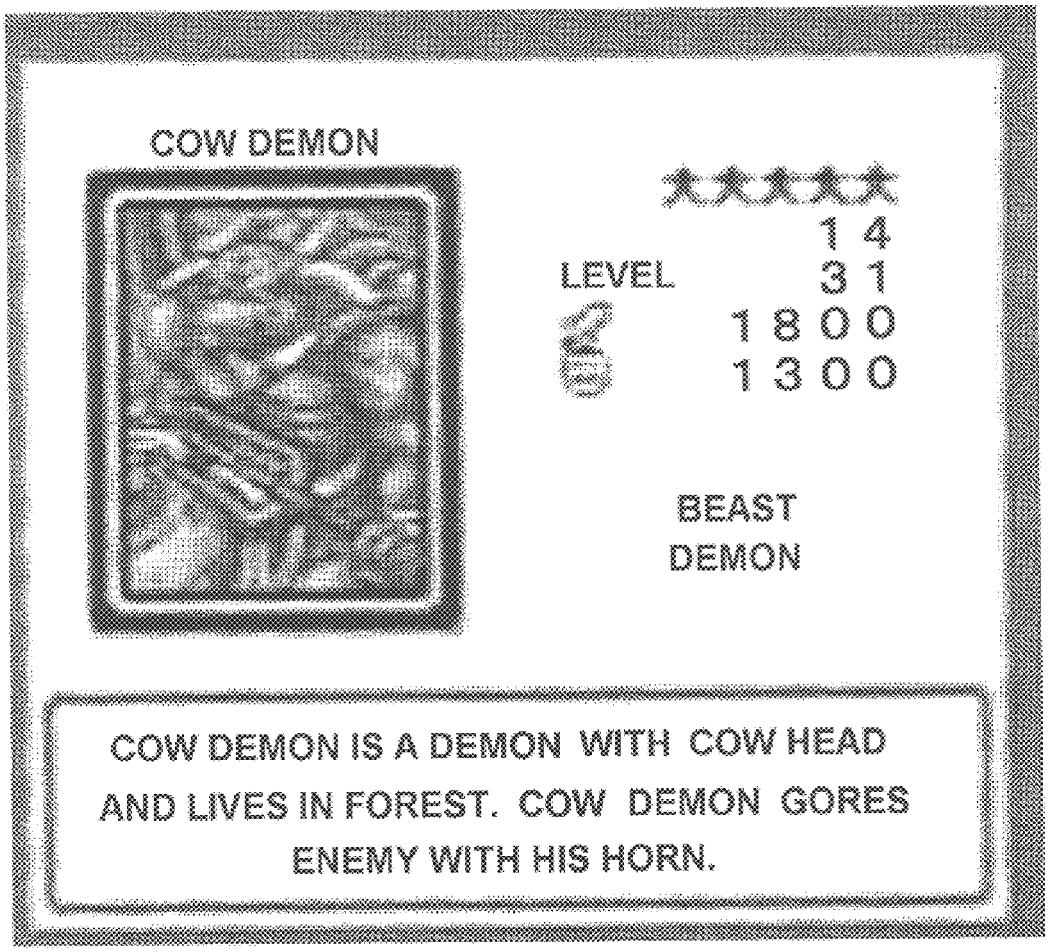
FIG. 6 shows a screen view for displaying ability points and properties of a card.

When no sacrificed card is required to present a card on the field, the card presentation process is performed in the following manner. It is assumed that a card "Mushroom monster" as shown in FIG. 5 will be presented on the field (STEP Sb1). The offense and defense points of "Mushroom monster" are 800 and 600 respectively. The index parameter is shown as number of stars (★) on the card face so that "Mushroom monster" has N=0 (STEP Sb2). Therefore, "Mushroom monster" requires no sacrificed card to be presented on the field (STEP Sb6).

When one sacrificed card is required to present a card on the field, the card presentation process is performed as following. It is assumed that some cards including a card "Murderer clown" have already been presented on the field.

First, a player selects a card "Cow demon" from his hand (STEP Sb1). The offense point, defense point and index parameter of "Cow demon" are 1800, 1300 and 5 respectively. Therefore, number of required sacrificed cards N is equal to one (STEP Sb2). Number of cards available for a sacrificed card is counted (STEP Sb3). If no card available for a sacrificed card is on the field, the process would lead to STEP Sb1 and require the player to select another card from his hand.

Now, there are some cards including "Murderer clown" on the field so that the process requires the player to select N cards from the cards on the field as sacrificed cards (STEP Sb4).

Figure 7:
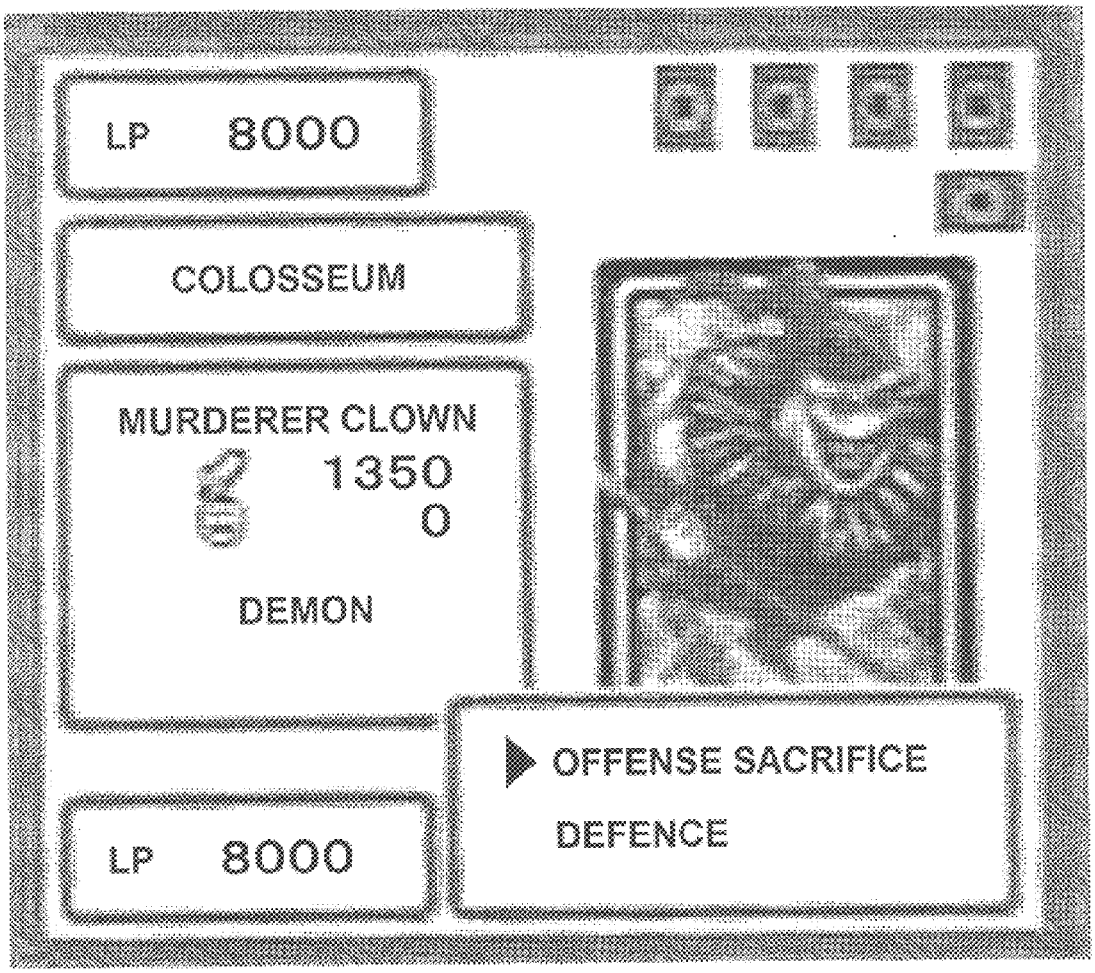
FIG. 7 shows a screen view for selecting a card as a sacrifice card.

When the player selects "Murderer clown" as the sacrificed card to present "Cow demon" on the field, three choices "Offense", "Defense" and "Sacrifice" are displayed on the screen as shown in FIG. 7. The player operates the cross key switch 13 and moves cursor on the LCD panel 12 so as to select "Murderer clown" as the sacrificed card. After selecting required number of sacrificed cards, the sacrificed card "Murderer clown" is removed (STEP Sb5) in a manner similar to the card that is removed on being lost at STEP Sa3 or Sa6. And instead of "Murderer clown", "Cow demon" is presented on the field (STEP Sb6).

(4) Other Embodiments of this Invention

While this invention has thus far been described in conjunction with an embodiment thereof, it will be readily possible for those skilled in the art to put this invention into various other manners. For example, this invention enables to introduce a new rule to a video game. Specifically, if a player wants to present a powerful card on the field, the player should have been required to present some sacrificed cards on the field prior to presenting the powerful card. In addition, the sacrifice rule according to this invention may be combined with any other rules. For example, the video game can include a card such that, if a player presents the card on the field, the player can control the opponent player's cards. In this case, controlled opponent's cards are available for sacrificed cards.

Though above-mentioned description was made on the assumption that two players duel with each other in the video game, it is obvious that one skilled in the art easily applies this invention to the video game that a player duels with a virtual player represented by the video game, what is called a CPU player. Besides, this invention is also available for the video game that is played among three or more players including one or more CPU players.

As mentioned above, this invention may introduce, into card-duel-type video games, a ritual for using a powerful card at the sacrifice of any other cards presented on the field. As a result, this invention can provide a lot of fun in such video games.

According to this invention, if a player wants to add a powerful card in his deck, the player should also add some weak cards for presenting on the field as sacrificed cards. As a result, this invention makes the game strategic because consideration should be paid on constructing a deck in the game.

According to this invention, even if a player possesses a lot of powerful cards, the player's deck should not be constructed only by the powerful cards but should always include any weak card or cards. Players should guess the opponent's deck and then construct their decks advantageous to the opponent's deck. As a result, this invention can provide fun of guessing the players at the opponent's deck.

And according to this invention, more powerful cards are easily introduced into the game. Even if a powerful card is introduced into the game, game balance can be adjusted by giving a lot of required sacrificed cards to the powerful card. Consequently, the difference between upper and lower limits of parameters can be enlarged so that a lot of card types or species can be issued. This is particularly important for computerized card game performed on a video game device that has no way for updating video game program or adding new card data.

What is claimed is:

1. A software product to be executed by a video game device, representing a card game on a virtual field each of whose cards has at least one parameter, repeating processes comprising the process of:

presenting a card from a player's hand on the field;

computing a judgement with reference to parameters of the cards on the field; and removing at least one card according to the judgement;

in order to represent one game, further comprising a card presentation process comprising the processes of:

designating a first card from a player's hand;

comparing an index parameter given to the first card with a predetermined threshold;

designating at least one card from currently presented cards on the field as a sacrificed card if the index parameter is over the threshold;

removing the sacrificed card from the field;

presenting the first card;

wherein the card presentation process decides the number of cards designated as sacrificed cards according to a parameter given to the first card.

2. A video game device performing a card game on a virtual field each of whose cards has at least one parameter, comprising processing units for:

presenting a card from a player's hand on the field;

computing a judgement with reference to parameters of the cards on the field; and removing at least one card according to the judgement; in order to representing one game, further comprising a card presentation processing unit comprising the processing units of:

designating a first card from a player's hand;

comparing an index parameter given to the first card with a predetermined threshold;

designating at least one card from currently presented cards on the field as a sacrificed card if the index parameter is over the threshold;

removing the sacrificed card from the field; and presenting the first card, wherein the card presentation processing unit decides number of cards designated as sacrificed cards according to a parameter given to the first card.

* * * * *